United States Patent [19]

Butterworth et al.

[11] Patent Number: 4,954,270

[45] Date of Patent: Sep. 4, 1990

[54] FABRIC SOFTENING COMPOSITION: FABRIC SOFTENER AND HYDROPHOBICALLY MODIFIED NONIONIC CELLULOSE ETHER

[75] Inventors: Robert M. Butterworth, Heidelberg, Fed. Rep. of Germany; Kenwyn D. Saunders, New Malden, Great Britain

[73] Assignee: Lever Brothers Company, New York, N.Y.

[21] Appl. No.: 316,379

[22] Filed: Feb. 27, 1989

[30] Foreign Application Priority Data

Mar. 1, 1988 [GB] United Kingdom ..... 8804818

[51] Int. Cl.[5] ..... C11D 1/62; C11D 3/22; D06M 13/18; D06M 15/09

[52] U.S. Cl. ..... 252/8.8; 8/137; 252/8.6; 252/8.9

[58] Field of Search ..... 252/8.8, 8.9, 8.7

[56] References Cited

U.S. PATENT DOCUMENTS 4,228,277 10/1980 Landoll ..... 536/90
4,767,547 8/1988 Straathof et al. ..... 252/8.8

FOREIGN PATENT DOCUMENTS 51983 5/1982 European Pat. Off. .

*Primary Examiner*—A. Lionel Clingman
*Attorney, Agent, or Firm*—Ronald A. Koatz

[57] ABSTRACT

An aqueous fabric conditioning composition comprising a fabric softener and a hydrophobically modified nonionic cellulose ether. Also covered is a method for treating fabrics with an aqueous liquor comprising the above composition.

6 Claims, No Drawings

FABRIC SOFTENING COMPOSITION: FABRIC SOFTENER AND HYDROPHOBICALLY MODIFIED NONIONIC CELLULOSE ETHER

This invention relates to a fabric softening composition and to a process for treating fabrics. Fabric softening compositions are used in textile finishing and laundering processes to impart properties such as softness and a pleasant feel or "handle" to fabrics, and are used particularly in a final stage of the laundering process immediately after the laundry articles have been washed in a washing machine.

A large number of proposals have been made to the formulation of fabric softening compositions, most of these involving the use of an aqueous dispersion of a cationic surfactant, for instance a quaternary ammonium salt or an imidazolinium salt, as the active component or as part of it. It is known from GB-A No. 2039556 that fabric softening compositions can be formulated to comprise a dispersion of cationic surfactant together with free fatty acid which functions as a nonionic surfactant.

The above compositions based on dispersions of cationic surfactants are non-Newtonian in character. In compositions intended for use by housewives in the home the viscosity (or strictly the apparent viscosity) of the composition is an important factor in its acceptability to the consumer, the more viscous compositions being perceived as being of higher quality than the more mobile ones. Manufacturers therefore attempt to produce a product which is as viscous as possible without being so viscous that problems are created elsewhere, such as in pouring or dispensing characteristics. In compositions intended for automated dispensing in washing machines, a low but tightly controlled viscosity is desirable, which again is difficult to achieve if the composition behaves unpredictably during manufacture and subsequent ageing.

Our EP-51983 discloses a process for the manufacture of a shear-thinning fabric softening composition, with good control of final viscosity, comprising the steps of sequentially or simultaneously:

(i) forming an aqueous dispersion of a cationic surfactant, having a viscosity less than the final viscosity; and (ii) thickening the composition to the final viscosity with a nonionic or weakly anionic polymeric thickener. The thickener is selected from guar gum, polyvinylacetate, polyacrylamide, or a mixture of guar gum and xanthan gum containing no more than 10% by weight of xanthan gum. The polyacrylamides which are specifically referred to are the less anionic polyacrylamides. Quaternised guar gum was stated to be unsuitable.

The essence of the process of EP No. 51983 is to form a dispersion which is less viscous than is desired, and then thicken it with a polymeric thickener.

We have now found that a further class of polymeric materials is especially suitable as a thickener for fabric conditioning compositions. These materials provide dispersions whose viscosity is relatively stable, and do not bring with it any disadvantage which would make the product unsatisfactory for treating fabrics.

These thickeners are hydrophobed nonionic cellulose ethers preferably such as disclosed by GB-A-2043646 (Hercules). This prior document asserts that these materials are useful as thickeners, but the stated application of them is as thickeners in latex paints.

Up till now it has not been recognised that, surprisingly, these materials can advantageously be incorporated in fabric conditioning systems, which are of a totally different nature than the latex systems in which the materials have been incorporated up till now.

Also a surprising aspect of the present invention is that the level of polymeric material, necessary to obtain the desired thickening effect is far less when using a hydrophobically modified cellulose ether material as presently claimed for use in softener systems than by using other thickener materials which have up till now been used for the thickening of fabric conditioning compositions.

Accordingly the present invention relates to an aqueous fabric conditioning composition comprising a fabric softener and a hydrophobically modified cellulose ether.

The cellulose ether substrate which is used to form the modified cellulose ether for use in compositions of this invention, can be any nonionic water-soluble cellulose ether substrate such as for instance, hydroxyethyl cellulose, hydroxypropyl cellulose, methyl cellulose, hydroxypropyl methyl cellulose, ethyl hydroxy ethyl cellulose and methyl hydroxyethyl cellulose. The preferred cellulose ether substrate is a hydroxyethyl cellulose.

The amount of nonionic substituent to the substrate such as methyl, hydroxyethyl or hydroxypropyl does not appear to be critical so long as there is sufficient to assure that the cellulose ether substrate is water-soluble.

The cellulose ether substrate to be modified is preferably of low to medium molecular weight i.e. less than about 800,000 and preferably between about 20,000 and 500,000, more preferred between 20,000 and 100,000.

The preferred modified cellulose ethers are as specified in GB-A-2043646 (Hercules), that is to say nonionic cellulose ethers having a sufficient degree of nonionic substitution selected from the class consisting of methyl, hydroxyethyl and hydroxypropyl to cause them to be water-soluble and which are further substituted with one or more hydrocarbon radicals having about 10 to 24 carbon atoms, in an amount between 0.2% by weight and the amount which renders the cellulose ether less than 1% by weight soluble in water at 20° C.

Especially preferred are hydrophobed hydroxyethyl cellulose available from Hercules Powder Company under their designation "WSP-D-330", "WSP-D-300" or an alternative designation "Natrosol Plus".

Depending upon the viscosity required, the cellulose ether thickener will be present in the composition of the invention in an amount of from 0.008 to 0.80% by weight, preferably from 0.01 to 0.30% by weight of the composition.

The fabric softener material for use in the fabric conditioning composition according to the invention can be any fabric substantive cationic, nonionic or amphotheric material suitable for softening fabrics.

Preferably the softener material is a cationic material which is water-insoluble in that these materials have a solubility in water at pH 2.5 and 20° C. of less than 10 g/l. Highly preferred materials are cationic quaternary ammonium salts having two C12-24 hydrocarbyl chains. Well-known species of substantially water-insoluble quaternary ammonium compounds have the formula

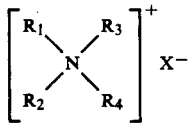

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals.

Representative examples of these quaternary softeners include ditallow dimethyl ammonium chloride; ditallow dimethyl ammonium methyl sulfate; dihexadecyl dimethyl ammonium chloride; di(hydrogenated tallow) dimethyl ammonium methyl sulfate; dihexadecyl diethyl ammonium chloride; di(coconut) dimethyl ammonium chloride. Ditallow dimethyl ammonium chloride, di(hydrogenated tallow) dimethyl ammonium chloride, di(coconut) dimethyl ammonium chloride and di(-coconut) dimethyl ammonium methosulfate are preferred.

Other preferred cationic compounds include those materials as disclosed in EP No. 239,910 (P&G), which is included herein by reference.

In this specification the expression hydrocarbyl group refers to alkyl or alkenyl groups optionally substituted or interrupted by functional groups such as —OH, —O—, —CONH, —COO—, etc.

Other preferred materials are the materials of formula

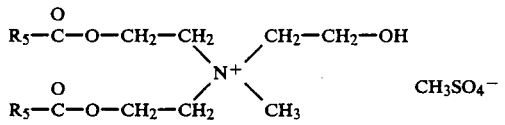

$R_5$ being tallow, which is available from Stepan under the tradename Stepantex VRH 90 and

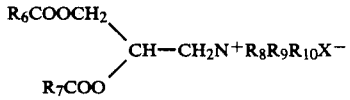

where $R_8$, $R_9$ and $R_{10}$ are each alkyl or hydroxyalkyl groups containing from 1 to 4 carbon atoms, or a benzyl group. $R_6$ and $R_7$ are each an alkyl or alkenyl chain containing from 11 to 23 carbon atoms, and $X^-$ is a water soluble anion, substantially free of the corresponding monoester.

Another class of preferred water-insoluble cationic materials are the hydrocarbylimidazolinium salts believed to have the formula:

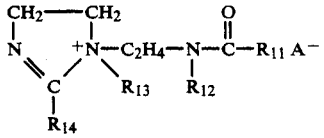

wherein $R_{13}$ is a hydrocarbyl group containing from 1 to 4, preferably 1 or 2 carbon atoms, $R_1$ is a hydrocarbyl group containing from 8 to 25 carbon atoms, $R_{14}$ is an hydrocarbyl group containing from 8 to 25 carbon atoms and $R_{12}$ is hydrogen or an hydrocarbyl containing from 1 to 4 carbon atoms and $A^-$ is an anion, preferably a halide, methosulfate or ethosulfate.

Preferred imidazolinium salts include 1-methyl-1-(tallowylamido-) ethyl -2-tallowyl- 4,5-dihydro imidazolinium methosulfate and 1-methyl-1(palmitoylamido)ethyl -2-octadecyl-4,5- dihydroimidazolinium chloride. Other useful imidazolinium materials are 2-heptadecyl-1-methyl-1- (2-stearylamido)-ethyl-imidazolinium chloride and 2-lauryl-1- hydroxyethyl-1-oleyl-imidazoinium chloride. Also suitable herein are the imidazolinium fabric softening components of U.S. Pat. No. 4,127,489, incorporated by reference.

Preferably the level of softening material in a composition according to the invention is from 1–75 weight %, preferably from 2–60% by weight more preferred from 2 to 15% by weight of the compositions.

The compositions may also contain preferably, in addition to the cationic fabric softening agent, other non-cationic fabric softening agents, such as nonionic or amphotheric fabric softening agents.

Suitable nonionic fabric softening agents include glycerol esters, such as glycerol monostearate, fatty alcohols, such as stearyl alcohol, alkoxylated fatty alcohols $C_9$–$C_{24}$ fatty acids and lanolin and derivatives thereof. Suitable materials are disclosed in European Patent Application Nos. 88 520 (Unilever PLC/NV case C 325), 122 141 (Unilever PLC/NV case C 1363) and 79 746 (Procter and Gamble), the disclosures of which are incorporated herein by reference. Typically such materials are included at a level within the range of from 1–75%, preferably from 2–60%, more preferred from 2 to 15% by weight of the composition.

The compositions according to the invention may also contain preferably in addition to cationic fabric softening agents, one or more amines.

The term "amine" as used herein can refer to (i) amines of formula

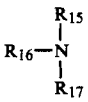

(I)

wherein $R_{15}$, $R_{16}$ and $R_7$ are defined as below;

(ii) amines of formula

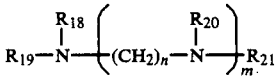

(II)

wherein $R_{18}$, $R_{19}$, $R_{20}$ and $R_{21}$, m and n are defined as below.

(iii) imidazolines of formula

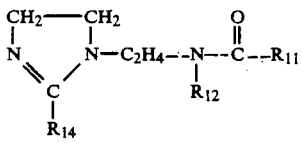

III wherein $R_{11}$, $R_{12}$ and $R_{14}$ are defined as above.

(iv) condensation products formed from the reaction of fatty acids with a polyamine selected from the group consisting of hydroxy alkylalkylenediamines and dialkylenetriamines and mixtures thereof. Suitable materials are disclosed in European Patent Application No. 199 382 (Procter and Gamble), incorporated herein by reference.

When the amine is of the formula I above, $R_{15}$ is a $C_6$ to $C_{24}$, hydrocarbyl group, $R_{16}$ is a $C_1$ to $C_{24}$ hydrocarbyl group and $R_{17}$ is a $C_1$ to $C_{10}$ hydrocarbyl group. Suitable amines include those materials from which the quaternary ammonium compounds disclosed above are derived, in which $R_{15}$ is $R_1$, $R_{16}$ is $R_2$ and $R_{17}$ is $R_3$. Preferably, the amine is such that both $R_{15}$ and $R_{16}$ are $C_6$–$C_{20}$ alkyl with $C_{16}$–$C_{18}$ being most preferred and with $R_{17}$ as $C_{1-3}$ alkyl, or $R_{15}$ is an alkyl or alkenyl group with at least 22 carbon atoms and $R_{16}$ and $R_{12}$ are $C_{1-3}$ alkyl. Preferably these amines are protonated with hydrochloric acid, ortho-phosphoric acid (OPA), $C_{1-5}$ carboxylic acids or any other similar acids, for use in the fabric conditioning compositions of the invention.

When the amine is of formula II above, $R_{18}$ is a $C_6$ to $C_{24}$ hydrocarbyl group, $R_{19}$ is an alkoxylated group of formula $-(CH_2CH_2O)_yH$, where y is within the range from 0 to 6, $R_{20}$ is an alkoxylated group of formula $-(CH_2CH_2O)_zH$ where z is within the range from 0 to 6 and m is an integer within the range from 0 to 6, and is preferably 3. When m is 0, it is preferred that $R_{18}$ is a $C_{16}$ to $C_{22}$ alkyl and that the sum total of z and y is within the range from 1 to 6, more preferably 1 to 3. When m is 1, it is preferred that $R_{18}$ is a $C_{16}$ to $C_{22}$ alkyl and that the sum total of x and y and z is within the range from 3 to 10.

Representative commercially available materials of this class include Ethomeen (ex Armour) and Ethoduomeen (ex Armour).

Preferably the amines of type (ii) or (iii) are also protonated for use in the fabric conditioning compositions of the invention.

When the amine is of type (iv) given above, a particularly preferred material is

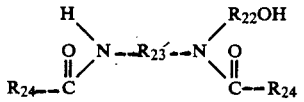

where $R_{22}$ and $R_{23}$ are divalent alkenyl chains having from 1 to 3 carbons atoms, and $R_{24}$ is an acyclic aliphatic hydrocarbon chain having from 15 to 21 carbon atoms. A commercially available material of this class is Ceranine HC39 (ex Sandoz).

Mixtures of the amines may also be used. When present amine materials are typically included at a level within the range of from 1–75%, preferably 2–60% more preferred 0,5 to 15% by weight of the composition.

Optionally compositions according the invention may also comprise one or more amine oxides of the formula:

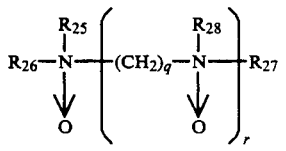

wherein $R_{25}$ is a hydrocarbyl group containing 8 to 24, preferably 10 to 22 carbon atoms, $R_{26}$ is an alkyl group containing 1 to 4 carbon atoms or a group of formula $-(CH_2CH_2O)_vH$, v is an integer from 1 to 6, $R_{27}$ is either $R_{25}$ or $R_{26}$, $R_{28}$ is $R_{26}$, r is 0 or 1 and q is 3.

The invention is particularly advantageous if the amine oxide contains two alkyl or alkenyl groups each with at least 14 carbon atoms, such as dihardened tallow methyl amine oxide, or one alkyl or alkenyl group with at least 22 carbon atoms. When present such materials are typically included at a level of from 1–75, preferably 2–60 more preferred 2 to 15% by weight of the composition.

Preferably, the compositions of the invention contain substantially no anionic material, in particular no anionic surface active material. If such materials are present, the weight ratio of the cationic fabric softening agent to the anionic material should preferably be more than 5:1.

The composition can also contain one or more optional ingredients selected from non-aqeous solvents such as $C_1$–$C_4$ alkanols and polyhydric alcohols, pH buffering agents such as strong or weak acids e.g. HCl, $H_2SO_4$, phosphoric, benzoic or citric acids (the pH of the compositions are preferably less than 5.0), rewetting agents, viscosity modifiers such as electrolytes, for example calcium chloride, antigelling agents, perfumes, perfume carriers, fluorescers, colourants, hydrotropes, antifoaming agents, antiredeposition agents, enzymes, optical brightening agents, opacifiers, stabilisers such as guar gum and polyethylene glycol, emulsifiers, anti-shrinking agents, anti-wrinkle agents, fabric crisping agents, anti-spotting agents, soil-release agents, germicides, linear or branched silicones, fungicides, anti-oxidants, anti-corrosion agents, preservatives such as Bronopol (Trade Mark), a commercially available form of 2-bromo-2-nitropropane-1,3-diol, dyes, bleaches and bleach precursors, drape imparting agents, antistatic agents and ironing aids.

These optional ingredients, if added, are each present at levels up to 5% by weight of the composition. The pH of the composition is preferably 5 or below, or adjusted thereto.

Fabric conditioning compositions according to the invention may be prepared by any conventional method for the preparation of dispersed softener systems. A well-known method for the preparation of such dispersed systems involves the preheating of the active ingredients, followed by formation of a pre-dispersion of this material in water of elevated temperature, and diluting said systems to ambient temperature systems.

The invention also provides a process for the manufacture of a shear-thinning fabric conditioner, comprising the steps of sequentially (a) forming an aqueous dispersion of a softener having a viscosity of less than the final viscosity; and (b) thickening the composition to a final viscosity by including a hydrophobically modified nonionic cellulose ether.

The final viscosity of the composition will be chosen in accordance with the end-use desired, but will generally be between 10 and 200 mPas, preferably between 20 and 120 mpas at 25° C. and 106 s-l.

In use, the fabric conditioning composition of the invention may be added to a large volume of water to form a liquor with which the fabrics to be treated are contacted. Generally, the concentration of the fabric softening agent, in this liquor will be between about 10 ppm and 1.000 ppm. The weight ratio of the fabrics to liquor will generally be between 40:1 and 4:1.

The invention will be further illustrated by means of the following examples.

Examples

In Examples 1–5, the cationic surfactant contained in all of the formulations referred to is di(hardened tallow) dimetyl ammonium chloride. The fatty acid employed is hardened tallow based. The hydrophobed hydroxyethyl cellulose, which is the thickener, is the above mentioned product of Hercules Powder Co Ltd, designated by them as WSP-D-330. It has a surface coating of glyoxal to delay solubilisation in water. It is therefore desirable to add a few drops of sodium hydroxide solution, to raise pH to 7–9 and remove the glyoxal, when dispersing this thickener in water.

Example 1

A fabric softening formulation was prepared in such a manner that the dispersed phase consisted of small spherical particles. This particle morphology contributes very little to viscosity.

This formulation was thickened with varying amounts of various thickening agents. These were guar gums, a cross linked polyacrylamide and a hydrophobed hydroxythyl cellulose. Use of the latter thickening agent falls within this invention.

The base formulation contained, by weight:

| | |
|---|---|
| Cationic surfactant | 4.46% |
| Fatty acid | 0.74% |
| Formalin | 0.20% |
| Minors (dye, opacifier, perfume) | 0.28% |
| Water | balance |

This is 5.2% by weight of actives, with a cationic: fatty acid ratio of 6:1.

The formulation was prepared by stirring the water at 60° C. at 250 rpm, adding the dye, opacifier and then a premix of the actives over a 10 minute period. After mixing until homogeneous, the mixture was cooled and the remaining ingredients mixed in at 40° C.

Samples of the formulation including each of the above thickening agents were prepared. Viscosities were measured with a Haake Rotovisco RV2 Viscometer at 106 $sec^{-1}$, at 25° C. Viscosity measurements were repeated after storage times of up to 12 weeks, to check viscosity stability. Results are given in Table 1 below.

| Thickening agents used were: | |
|---|---|
| Guar Gum TK/225 | nonionic, unmodified long chain cellulose polymer. |
| Jaguar HP11 | nonionic hydroxypropylated guar gum. |
| Meypro Guar CSAA M-175, Meypro Guar CSA 200/50 | nonionic, unmodified long chain cellulose polymer. |

-continued

| Thickening agents used were: | |
|---|---|
| WSP-D-330 | hydrophobed hydroxyethyl cellulose. |

The finished formulations were allowed to stand for up to 24 hours to allow viscosity to build up fully.

For comparison, viscosity measurement were also carried out on a formulation (formulation G) with 4.8% cationic surfactant and 0.5% fatty acid, giving a 9.6:1 ratio at an active level of 5.3%.

It can be seen from Table 1 that the hydrophobed hydroxyethyl cellulose is effective at the lowest concentration.

Storage tests were also carried out with storage at 0° C. and 28° C. The results are quoted in Tables 2 and 3 which reveal that the various guar gum products were not stable at 28° C., and apparently undergoing some form of decomposition.

The viscosities of (i) the formulation F which contains 0.025% by weight of hydrophobed hydroxyethyl cellulose, and (ii) formulation G were measured at various shear rate (viscosity profile) gave curves of similar shape in each case.

TABLE 1

VISCOSITIES (m.PaS at 106 $sec^{-1}$, 25° C.)

| FORMULATION | | STORAGE TIMES (Weeks at 20° C.) 0 | 1 | 2 | 4 | 8 | 12 |
|---|---|---|---|---|---|---|---|
| A Unthickened control | | 12 | 15 | 14 | 14 | 13 | 12 |
| B Guar TH/225 | 0.2% | 76 | 73 | 71 | 66 | 60 | 56 |
| C Jaguar HP-11 | 0.2% | 58 | 53 | 52 | 49 | 45 | 43 |
| D Meypro Guar CSAA M-175 | 0.2% | 68 | 63 | 63 | 69 | 53 | 50 |
| E Meypro Guar CSAA 200/50 | 0.2% | 75 | 71 | 68 | 63 | 54 | 54 |
| F WSP-D-330 | 0.025% | 72 | — | 81 | 86 | 79 | 81 |
| G Comparative Product | | 58 | 58 | 57 | 56 | 53 | 55 |

TABLE 2

VISCOSITIES (m.PaS at 106 $sec^{-1}$, 25° C.)

| FORMULATION | | STORAGE TIMES (Weeks at 0° C.) 0 | 1 | 2 | 4 | 8 | 12 |
|---|---|---|---|---|---|---|---|
| A Unthickened control | | 12 | 14 | 14 | 14 | 15 | 13 |
| B Guar TH/225 | 0.2% | 76 | 78 | 80 | 78 | 79 | 78 |
| C Jaguar HP-11 | 0.2% | 58 | 58 | 58 | 56 | 57 | 56 |
| D Meypro Guar CSAA M-175 | 0.2% | 68 | 68 | 69 | 69 | 69 | 68 |
| E Meypro Guar CSAA 200/50 | 0.2% | 75 | 74 | 76 | 75 | 78 | 76 |
| F WSP-D-330 | 0.025% | 72 | — | 72 | 76 | 76 | 73 |
| G Comparative Product | | 58 | 60 | 66 | 68 | 73 | 75 |

TABLE 3

VISCOSITIES (m.PaS at 106 $sec^{-1}$, 25° C.)

| FORMULATION | | STORAGE TIMES (Weeks at 28° C.) 0 | 1 | 2 | 4 | 8 | 12 |
|---|---|---|---|---|---|---|---|
| A Unthickened control | | 12 | 14 | 14 | 13 | 14 | 12 |
| B Guar TH/225 | 0.2% | 76 | 73 | 64 | 58 | 48 | 43 |
| C Jaguar HP-11 | 0.2% | 58 | 52 | 50 | 45 | 38 | 33 |
| D Meypro Guar CSAA M-175 | 0.2% | 68 | 63 | 60 | 53 | 45 | 38 |
| E Meypro Guar CSAA 200/50 | 0.2% | 75 | 71 | 63 | 57 | 46 | 40 |
| F WSP-D-330 | 0.025% | 72 | — | 72 | 75 | 72 | 72 |

TABLE 3-continued

| VISCOSITIES (m.PaS at 106 $sec^{-1}$, 25° C.) | | | | | | |
|---|---|---|---|---|---|---|
| | STORAGE TIMES (Weeks at 28° C.) | | | | | |
| FORMULATION | 0 | 1 | 2 | 4 | 8 | 12 |
| G Comparative Product | 58 | 55 | 56 | 51 | 50 | 50 |

Example 2

A fabric softening formulation was prepared by a route in which the formulation receives a high level of continuous mechanical processing, leading to a disperse phase containing small regular-shaped particles. In such a formulation, particle morphology makes very little contribution to viscosity.

A base formulation without thickening agent was prepared as a concentrate containing cationic surfactant and fatty acid in a weight ratio of 4.2:1, with these actives together constituting 18% by weight of the concentrate.

Diluted solutions containing various thickening agents were prepared by adding the thickening agent to demineralised water with vigorous stirring at 20° C. (except for gelatin which was dissolved at 60° C.).

Samples of the concentrate were diluted with three times their own volume of diluting solution at 45° C. and stirred until homogeneous (3 min at 400 rpm) to give thickened formulations containing 4% by weight of the actives.

After equilibration for 24 hours at 20° C., the viscosities of the samples were measured using a Ferranti (Registered Trade Mark) Cup and Bob Viscometer at 20° C. and 110 $sec^{-1}$. Results are set out in Table 4 below.

Samples were also subjected to freeze/thaw cycling 16 hours at −10° C. followed by 8 hours at 20° C. Viscosities after one and two such cycles were estimated by an experienced observer able to estimate to ±50 m.Pas Results are also given in Table 4 below.

TABLE 4

| BASE FORMULATION THICKENED WITH: | INITIAL VISCOSITY (m.PaS at 110 $sec^{-1}$ | VISUAL ASSESSMENT OF VISCOSITY AT RT AFTER: 1 CYCLE −10° C./RT | 2 CYCLES −10° C./RT |
|---|---|---|---|
| Unthickened Control | 5 | 50 | 100 |
| Gelatin (Polyelectrolyte) | | | |
| 0.3% | 6 | 50 | 100 |
| 0.6% | 11 | 100 | 400 |
| 0.9% | 61 | 400 | Solid |
| Guar CSA 200/50 (Guar Gum Derivative) 0.4% | 61 | 400 | 400 |
| Natrosol 250 HHBR (Hydroxyethyl Cellulose) 0.3% | 34 | 300 | 400 |
| Bermocoll E341 0.67% (Ethyl Hydroxyethyl Cellulose) | 65 | 250 | 400 |
| WSP-D-300 (Hydrophobed Hydroxyethyl Cellulose) | | | |
| 0.1% | 34 | 100 | 100 |
| 0.13% | 78 | 100 | 100 |
| 0.15% | 101 | 150 | 100 |
| Kelzan S (Anionic Cellulosic Polymer) 0.3% | Separated | — | — |
| Crosfloc CFN10 (Nonionic Polyacrylamide) 0.3% | 18 | 240 | 400 |
| Versicol 525 (Anionic Polyacrylate) 0.3% | Separated | — | — |

From the initial viscosities in Table 4 it can be seen that the hydrophobed hydroxyethyl cellulose gave thickening to a level of 78 m.Pas at a concentration of only 0.13%. Other thickening agents which are not in accordance with this invention needed levels of at least 0.3% to achieve as much thickening.

Freeze/thaw cycling is an extreme test of low temperature viscosity stability. The diluted, unthickened formulation was fairly stable to this, as were the formulations thickened with hydrophobed hydroxyethyl cellulose. Other thickeners gave excessive thickening.

Example 3

The effect of the WSP-D-330, i.e. hydrophobed, hydroxyethyl cellulose, on the fabric softening properties of a formulation was investigated.

Terry towelling squares were treated with: formulations F and G of Example 1.

Treatment was carried out in a Tergotometer under the following conditions:

| | |
|---|---|
| agitation: | 75 rpm |
| liquor: | 1 liter 26° French Hardness water |
| temperature: | room temperature |
| number of rinses: | 5 |
| rinse time: | 4 minutes |
| dosage: | 1 ml product |
| cloths: | 2 squares, measuring 20 cm × 20 cm |

Cloths were then line-dried overnight at room temperature and then transferred to a constant humidity room (20° C., 50% r.h) for 24 hours. The tactile feel of the cloths was assessed by panellists using a fully-randomised statistical analysis. No significant difference was found.

Example 4

The effect of the WSP-D-330, i.e. hydrophobed hydroxyethyl cellulose, on the whiteness of fabric was investigated to check for any cumulative "greying" of white cotton or "blueing" of white fabric laundered with blue-pigmented detergent powder. White cotton and white polyester 20 cm squares were treated through full wash (50° C.) and rinse cycles a total of 10 times.

Half of each group were washed with a "white" powder and half with a "blue" powder. Cloths in each of the groups were treated during the rinse with:

(a) formulation F of Example 1.
(b) formulation G of Example 1.
(c) no formulation (control).

All cloths were dried in a drying cabinet at medium heat and then stored in polythene bags in the dark until analysis.

Using a colour analyser, cloths were analysed for:

(a) overall colour change;
(b) "blueing" as shown by changes in the yellow-neutral-blue part of the spectrum; and
(c) "greying" as shown by changes in lightness/darkness.

The colour analyser was a spectrophotometer (model MS 2020 of Macbeth Corporation, Chicago) interfaced to a mini computer. It provides a numerical assessment of colour changes, termed E, on units on a scale (the CIELAB system) where increasing numerical magnitude represents increasing degree of colour change. Results are shown in Table 5 below.

TABLE 5

| | COLOUR CHANGES (ΔE) | | | | | | | | | | | |
|---|---|---|---|---|---|---|---|---|---|---|---|---|
| | OVERALL COLOUR CHANGE | | | | "BLUEING" | | | | "GREYING" | | | |
| | COTTON | | POLYESTER | | COTTON | | POLYESTER | | COTTON | | POLYESTER | |
| | B | W | B | W | B | W | B | W | B | W | B | W |
| Formulation L | 1.0 | 1.55 | 0.58 | 1.3 | −0.48 | −1.00 | −0.15 | −0.55 | −0.48 | −0.95 | −0.48 | −1.20 |
| Formulation K | 1.23 | 1.97 | 0.78 | 1.23 | −0.55 | −1.12 | −0.1 | −0.5 | −0.30 | −0.85 | −0.70 | −0.10 |
| Control No Rinse Conditioner | 1.38 | 2.45 | 0.53 | 1.28 | −0.53 | −1.33 | +0.3 | −0.48 | −0.7 | −1.28 | −0.4 | −1.20 |
| | | | | | | − = Yellower<br>+ = Bluer | | | | − = Darker<br>+ = Lighter | | |

KEY:
B = Washing powder containing blue pigment
W = Washing powder that does not contain blue pigment The results showed no substantial difference in colour with formulation F or formulation G as compared with the control. Similarly there was no trend towards "blueing" for either fabric treated with either formulation. The results showed a slight "yellowing" in polyester treated with either formulation, but no substantial difference between the two. Results also showed that use of either of the formulations F or G produced no more of a cumulative greying effect than was found in the control.

All of the effects noted were so small as not to be discernable by eye.

Example 5

| | |
|---|---|
| Cationic surfactant: | 12.80% |
| Hardened tallow fatty acids: | 3.20% |
| Perfume: | 0.55% |
| Calcium chloride, preservative, water: | balance to 100%. |

This is 16% by weight of actives, with a cationic: fatty acid ratio of 4:1. This formulation was prepared with a high level of mechanical processing so that there was little or no morphological contribution to its viscosity. Its viscosity, measured with a Haake Rotovisco RV2 Viscometer at 106 sec-1 at 25° C. was 80m.Pas.

Varying amounts of Hercules WSP-D-300 were added as a 2% dispersion in water. This enabled the viscosity to be increased, as set out in Table 6 below.

TABLE 6

| Wt % polymer in formulation | Viscosity, m.Pas at 106 $sec^{-1}$ at 25° C. |
|---|---|
| 0.004 | 91 |
| 0.008 | 103 |
| 0.013 | 111 |
| 0.020 | 134 |

The base formulation was thinned to a viscosity of 50 m.Pas at 106 $sec^{-1}$ at 25° C. by incorporating an additional quantity of calcium chloride. The level of calcium chloride was then 0.029% by weight of the composition. Varying amounts of the same thickener were added, to give viscosities as set out in Table 7 below.

TABLE 7

| Wt % polymer in product | Viscosity, m.Pas at 106 $sec^{-1}$ at 25° C. |
|---|---|
| 0.016 | 94 |
| 0.018 | 104 |
| 0.020 | 110 |

It will be appreciated that these techniques enable the viscosity of the final formulation to be controlled.

Example 6

A basic fabric softener composition of the following composition was prepared by pre-mixing the ingredients at a temperature of 60° C. and subsequent dilution with water:

| Ingredient | % by weight |
|---|---|
| Stepantex VRH90 | 4.5 |
| Proxel XL2 (preservative)[a] | 0.02 |
| Perfume | 0.21 |
| Colourants | 0.00055 |
| Water | balance |

[a]Proxel XL2 is a 9.5% aqueous/propylene glycol solution of 1,2 benzisothiozolin-3 ex ICI.

The viscosity at 25° C. and 106 s-l of the mix was measured before and after addition thereto of 0.03% Natrosol Plus ex Hercules, the results were the following:

| | |
|---|---|
| viscosity without Natrosol | 1.8 mPas |
| viscosity with Natrosol | 13 mPas |

Example 7

A fabric conditioner basic mix of the following composition was prepared as described in example 6:

| Ingredient | % by weight |
|---|---|
| Arquad 2HT | 3.5 |
| Ceranine HC39 | 3.5 |
| Perfume, dye, phosphoric acid | |
| Preservative (Proxel XL2) | 0.35% |
| Water | balance |

The pH of the composition is 2.8.

The viscosity of the product was measured at 25° C. and 106 s-l before and after the addition of 0.03% by weight of Natrosol Plus.

The results were the following

| | |
|---|---|
| before addition of Natrosol | 31.5 mPas |
| after addition of Natrosol | 46 mPas |

Example 8

A basic fabric conditioner composition of the following composition was prepared according to the method of example 6.

| Ingredient | % by weight |
|---|---|
| Arquad HT | 2.1 |
| Non-quaternised imidazoline[a] | 4.2 |
| Silicone[b] | 0.2 |
| Minors | 0.4 |
| Water | balance |

[a]is Rewopon 1255 ex Rewo

[b]is a di methyl poly siloxane having a viscosity of 100,000 cSt at 110 $s^{-1}$ The viscosity of the product was measured at 25° C. at 106 s-l before and after the addition of 0.03% by weight of Natrosol Plus, the results were the following:

| | |
|---|---|
| viscosity without Natrosol | 3.5 mPas |
| viscosity with Natrosol | 82 mPas |

Example 9

Two basic fabric conditioner compositions of the following composition was prepared according to the method as described in example 6.

| Ingredient | composition A % by weight | composition B % by weight |
|---|---|---|
| Arquad 2HT | 4.5 | 10.4 |
| Fatty acid[a] | — | 2.6 |
| Minor ingredients | 0.2 | 0.2 |
| pH | 2.7 | 3.0 |
| Water | balance | |

[a]is Prissterine 4916 ex Unichema

The viscosity of the products was measured at 25° C. and 106 s-l before and after the addition of 0.03% of Natrosol Plus, the following results were obtained:

| | A | B |
|---|---|---|
| viscosity before addition of Natrosol | 28 mPas | 33 mPas |
| viscosity after addition of Natrosol | 560 mPas | 328 mPas |

Example 10

A basic fabric conditioner composition of the following composition was prepared according to the method of example 6.

| Ingredient | % by weight |
|---|---|
| Stepantex VRH90 | 2.25% |
| Armeen[a] | 2.25% |
| Water | balance |

The viscosity of the product was measured at 25° C. and 106 s-l before and after the addition of 0.03% of Natrosol plus. The following results were obtained. Viscosity before addition of Natrosol 5.5 mPas Viscosity after addition of Natrosol 34 mPas.

We claim:

1. An aqueous fabric conditioning composition comprising (i) a fabric softener selected from the group of water-insoluble quaternary ammonium compounds, water-insoluble hydrocarbyl imidazolinium compounds, nonionic fabric softening agents, amine softening materials or mixtures thereof; and (ii) from 0.01 to 0.30% by weight of a nonionic cellulose ether which is a methyl, hydroxyethyl or hydroxypropyl cellulose having a degree of substitution sufficient to make it water soluble prior to being hydrophobically modified which has been hydrophobically modified by substitution with one or more hydrocarbon radicals having 10–24 carbon atoms in an amount between 0.20% by weight and the amount which renders the modified cellulose ether less than 1% by weight soluble in water at 20° C.

2. An aqueous fabric conditioning composition according to claim 1, wherein the fabric softener comprises a cationic fabric softener material selected from the group of water-insoluble quaternary ammonium compounds and water-insoluble hydrocarbylimidazolinium compounds.

3. An aqueous fabric conditioner composition according to claim 1, wherein the cellulose ether substrate before modification has a molecular weight of between 20,000 and 100,000.

4. An aqueous fabric conditioning composition according to claim 1 wherein the cellulose ether substrate before modification is a hydroxy-ethyl cellulose.

5. An aqeous fabric conditioning composition according to claim 1 comprising from 1–75% by weight of the softening material.

6. Method for the treatment of fabrics wherein fabrics are contacted with an aqueous liquor comprising a fabric conditioning composition according to claim 1, the concentration of fabric softener in the liquor being between 10 and 1,000 ppm.

* * * * *